US008642865B2

(12) United States Patent
Ostendorf

(10) Patent No.: US 8,642,865 B2
(45) Date of Patent: Feb. 4, 2014

(54) MUSICAL WIND INSTRUMENT WITH INNER WAVEGUIDE REFLECTOR ASSEMBLY

(71) Applicant: Philip Joseph Ostendorf, Stuart, FL (US)

(72) Inventor: Philip Joseph Ostendorf, Stuart, FL (US)

( * ) Notice: Subject to any disclaimer, the term of this patent is extended or adjusted under 35 U.S.C. 154(b) by 0 days.

(21) Appl. No.: 13/786,399

(22) Filed: Mar. 5, 2013

(65) Prior Publication Data

US 2013/0233147 A1 Sep. 12, 2013

Related U.S. Application Data

(60) Provisional application No. 61/634,725, filed on Mar. 6, 2012.

(51) Int. Cl.
*G10D 9/00* (2006.01)

(52) U.S. Cl.
USPC ..... 84/387 R

(58) Field of Classification Search
USPC ..... 84/387 R
See application file for complete search history.

(56) References Cited

U.S. PATENT DOCUMENTS

| | | | | |
|---|---|---|---|---|
| 903,059 | A | 11/1908 | Conn | |
| 962,574 | A | 6/1910 | Kaufman | |
| 982,732 | A | 1/1911 | Lehnert | |
| 1,301,147 | A | 4/1919 | Magin | |
| 1,338,108 | A | 4/1920 | Sordillo | |
| 1,342,846 | A | 6/1920 | Emma | |
| 1,362,326 | A * | 12/1920 | Kidder | 181/185 |
| 1,445,115 | A | 2/1923 | Turner | |
| 2,059,898 | A | 11/1936 | Osborne | |
| 2,244,205 | A | 6/1941 | Koeder | |
| 2,470,597 | A | 5/1949 | Woodward | |
| 3,529,505 | A | 9/1970 | Brooks | |
| 4,012,983 | A * | 3/1977 | Ploeger | 84/400 |
| 4,273,021 | A | 6/1981 | Mackie | |
| 4,273,022 | A | 6/1981 | Bell | |
| 4,516,464 | A | 5/1985 | Hastings | |

(Continued)

FOREIGN PATENT DOCUMENTS

| | | |
|---|---|---|
| CH | 47280 | 6/1909 |
| GB | 2559 | 0/1861 |
| GB | 2766 | 0/1858 |
| GB | 235083 | 6/1925 |

OTHER PUBLICATIONS

Montagu, "The World of Romantic & Modern Musical Instruments", The Overlook Press, Woodstock, NY, 1981, pp. 76-81 and 92-94.

*Primary Examiner* — Robert W Horn
(74) *Attorney, Agent, or Firm* — Thomas E. Lees, LLC

(57) ABSTRACT

An attachment is provided, which is to be clipped to the bell of a contemporary wind instrument, hereinafter called a horn, such as a trumpet, trombone, euphonium, etc., permitting musical playing by lip control alone, eliminating the need for valves, or scale slides. An attachment bracket is designed to support one, or more, tubular waveguide reflectors. The waveguide reflectors each have a proximal end near the bell end of the horn and extend relative to the horn's mouthpiece, toward a distal end, at a calculated position, producing a fundamental pitch of one scale tone lower or higher, as may be required, from the fundamental pitch of the horn. A single port may be added to the horn calculated to produce a fundamental pitch, one tone higher than the fundamental pitch of the horn, providing the sharps and flats for a full chromatic scale.

20 Claims, 4 Drawing Sheets

(56) References Cited

U.S. PATENT DOCUMENTS 4,885,971 A 12/1989 Ostendorf
4,998,959 A * 3/1991 Purdie ..... 84/400
5,133,238 A * 7/1992 Ostendorf ..... 84/387 R
5,351,593 A * 10/1994 Ostendorf ..... 84/387 R
5,373,771 A * 12/1994 Weik et al. ..... 84/400
6,080,924 A * 6/2000 Cowen et al. ..... 84/453

* cited by examiner

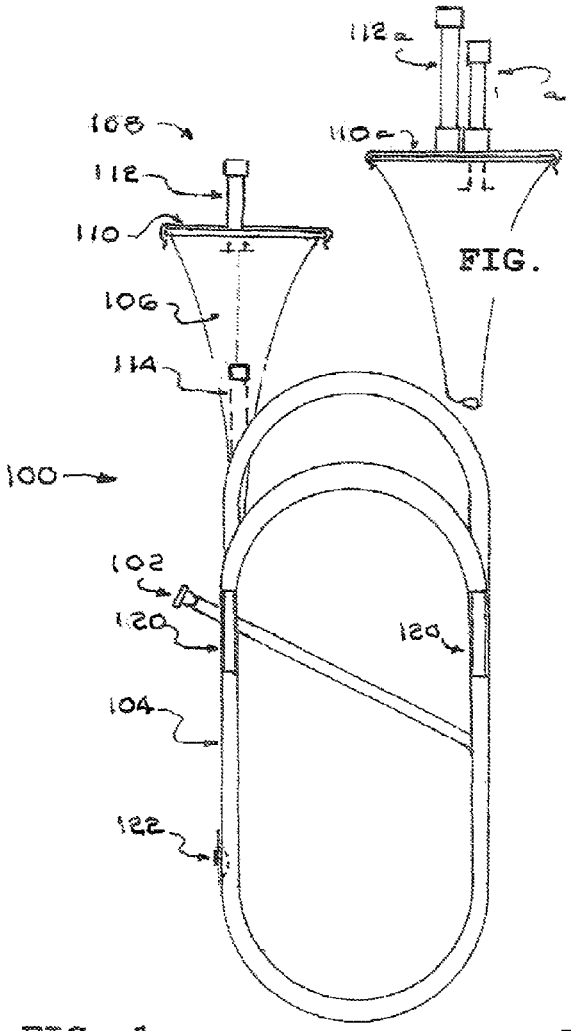
FIG. 1
FIG. 1a
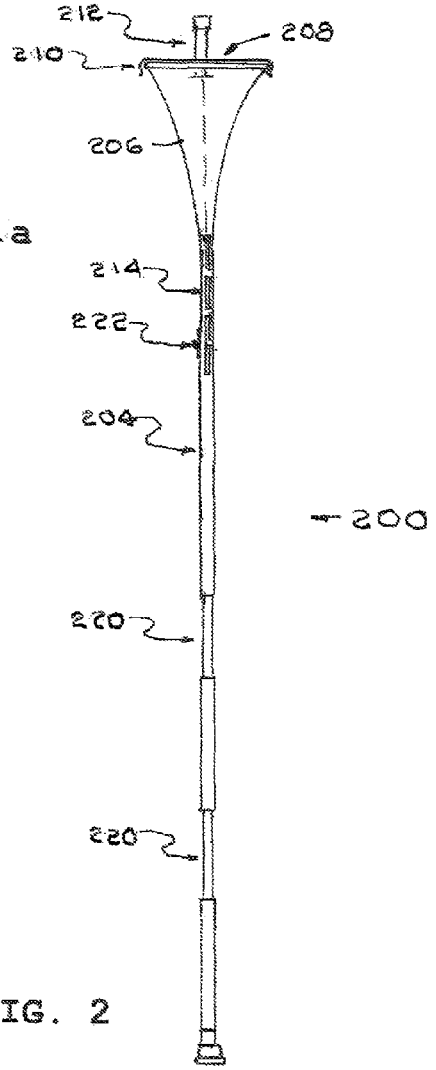
FIG. 2

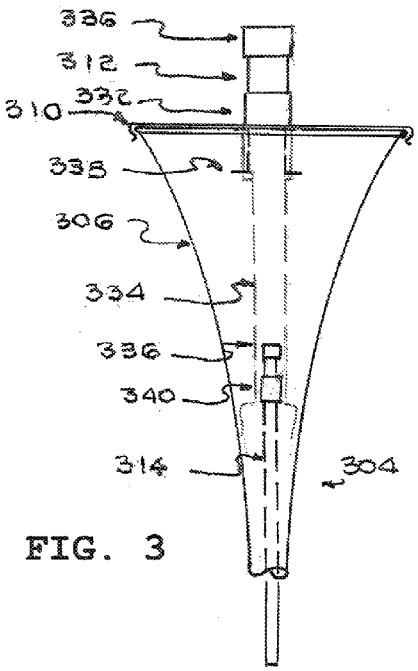
FIG. 3
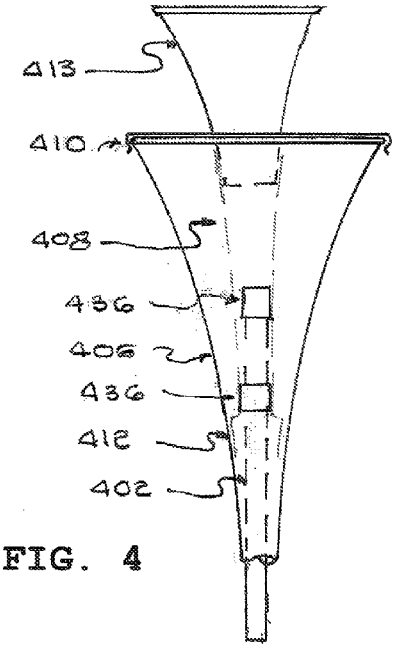
FIG. 4
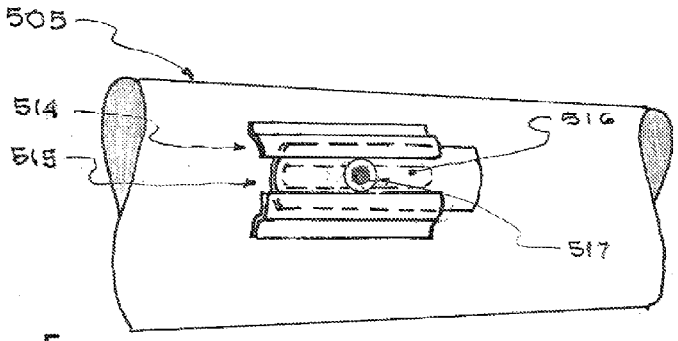
FIG. 5
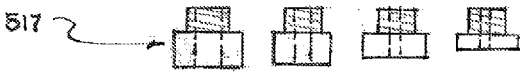

MUSICAL WIND INSTRUMENT WITH INNER WAVEGUIDE REFLECTOR ASSEMBLY

CROSS REFERENCE TO RELATED APPLICATIONS

This application claims the benefit of U.S. Provisional Patent Application Ser. No. 61/634,725 filed Mar. 6, 2012, entitled "MUSICAL WIND INSTRUMENT W/INNER HORN IMPROVEMENT UPON", the disclosure of which is hereby incorporated by reference.

BACKGROUND

This disclosure relates broadly to wind operated musical instruments and particularly to those musical instrument that are resonant in response to vibrating air columns induced therein to produce and amplify the sound waves, resulting in various musical notes.

A horn produces sound through the movement of an enclosed column of air, which is typically produced by the breath of the horn player. For instance, hollow animal horns and conical conch shells were among the earliest varieties of horn. Moreover, horns have been used in purely musical contexts for hundreds of years. Almost any length of tube can serve as a horn of sorts. In this regard, all horns have two common features. A horn has a fundamental pitch frequency (Ff) and can play the members of that fundamental pitch's family of pitch frequencies (n×Ff). For instance, the common bugle has a single fixed length and is, therefore, capable of resonating only at frequencies within a single harmonic series. Thus, the bugle cannot produce a complete major, minor or chromatic scale by itself.

Many approaches have been attempted and implemented to provide a full scale of musical notes. One solution was to have seven 'bugles', each, longer (or shorter) than the previous bugle. Each bugle has a half tone pitch frequency separation from the previous bugles' note of the chromatic scale. However, in use, the performer plays each bugle on its' turn, as the musical composition may require.

Another solution provided seven crooks of tubing each longer (or shorter) than the previous. The crooks are inserted in the horn's circuit of air column, to permit a full chromatic scale. However, this approach is often impractical, especially for fast tempo performances, due to the time required to pull one crook and substitute another.

In order to produce more complete scales, most wind instruments are provided with mechanisms to change the effective air column length. Such mechanisms usually comprise telescoping slides, open-able ports, depressible piston keys or rotary valves that provide openings to differing length combinations of tubing sections. Because of the ability to change the effective air column lengths, the instruments can be used to produce many families of harmonic series required to produce scales. The usefulness of the instrument depends of course upon the proficiency, dexterity, and instant recall memory of the player.

BRIEF SUMMARY

According to aspects of the present disclosure herein, an attachment for a musical wind instrument (horn) is provided. The attachment comprises a waveguide reflector assembly including a support bracket that clips to a bell of the musical wind instrument, and a waveguide reflector comprising a waveguide and a reflector. The waveguide and reflector are positioned adjustably by the support bracket so that a produced pitch is controlled by integral half wavelength filtering of input frequencies that match only the fundamental pitch selected to be one chromatic scale note lower than the fundamental pitch of the horn, bringing the entire family of related harmonic pitches and adding a capability to provide a complete major scale of over two octaves, controlled only by the lips of the player.

For instance, in an illustrative implementation, the waveguide reflector is pitched (e.g., dimensioned, tuned or otherwise configured), and positioned adjustably by the support bracket so as to achieve a specific distance and position that establishes an integral number of desired half wave lengths from a mouthpiece of the musical wind instrument to a reflecting surface of the waveguide reflector at a pitch one chromatic scale note lower (e.g., Ff divided by 1.05946) than the fundamental pitch (Ff) of the horn, adding to the horn a capability to provide a complete major scale of over two octaves to the assembly, controlled only by the lips of the player. By way of example, a distal end of the waveguide reflector may be positioned at a distance from the mouthpiece of the musical wind instrument equal to a whole number sum of half wave lengths of the pitch selected.

According to further aspects of the present disclosure, the waveguide reflector assembly may further comprise a second waveguide reflector and optionally a third waveguide reflector. The second waveguide reflector is positioned adjustably by the support bracket so that a produced pitch is controlled by integral half wavelength filtering of input frequencies that match only the fundamental pitch selected to be at a pitch that is the second note higher in the chromatic scale beginning with the fundamental pitch of the horn, bringing the entire family of related harmonic pitches and adding a capability to provide a complete major scale of over two octaves, controlled only by the lips of the player. Correspondingly, the third waveguide reflector is positioned adjustably by the support bracket so that a produced pitch is controlled by integral half wavelength filtering of input frequencies that match only the fundamental pitch selected to be at a pitch that is the third note higher in the chromatic scale beginning with the fundamental pitch of the horn, bringing the entire family of related harmonic pitches and adding a capability to provide a complete major scale of over two octaves, controlled only by the lips of the player.

By way of illustration, each additional waveguide reflector may be pitched and positioned adjustably by the support bracket so as to achieve a specific distance and position that establishes an integral number of desired half wave lengths from the mouthpiece of the musical wind instrument to a reflecting surface of the waveguide reflector. Moreover, the second waveguide reflector may be configured at a pitch that is the second note lower in the chromatic scale (e.g., Ff divided by 1.05946) beginning with the fundamental pitch (Ff) of the horn. The proximal end of the second waveguide reflector or a port may positioned at a distance from the mouthpiece of the musical wind instrument equal to a whole number sum of half wave lengths of the pitch selected. Correspondingly, the optional third waveguide reflector may be configured at a pitch that is the third note higher in the chromatic scale beginning with the fundamental pitch of the horn, providing the notes needed to extend the horn's lower range to a scale of over two octaves (e.g., two and one-half octaves).

According to further aspects of the present disclosure, in exemplary implementations, each waveguide reflector may be open, belled, domed or flat on the distal end; open, closed, tapered, squared, or flanged on the proximal end, and cylindrical, conical, or return bent along the body, in any desired combination of the above. Moreover, the waveguide reflector may comprise a cap reflector that provides a first family of pitches and a flange at the base of the wave guide reflector that provides a second reflector to reflect a second family of pitches. Still further, in certain illustrative implementations, the waveguide reflector may have a slide length adjustment on a body of the waveguide for fine-tuning its fundamental pitch.

According to still further aspects of the present disclosure, a musical wind instrument comprises a bell, a mouthpiece, a horn assembly comprising a tube that connects the bell to the mouthpiece through a hollow in the tube, and a waveguide reflector assembly. The waveguide reflector assembly comprises a support bracket that clips to a bell of the musical wind instrument, and a waveguide reflector comprising a waveguide and a reflector. The waveguide and reflector are positioned adjustably by the support bracket so that a produced pitch is controlled by integral half wavelength filtering of input frequencies that match only the fundamental pitch selected to be one chromatic scale note lower than the fundamental pitch of the horn, bringing the entire family of related harmonic pitches and adding a capability to provide a complete major scale of over two octaves, controlled only by the lips of the player.

According to yet further aspects of the present disclosure, the musical wind instrument may have the same optional features of the attachment described above.

Moreover, according to yet further aspects of the present disclosure, the musical wind instrument may optionally further comprise a port positioned along the horn that is adjustably located and pitched to provide the next adjacent higher fundamental scale tone (e.g., Ff times 1.05946) in sequence, beginning with the fundamental note of the horn (Ff), in the scale of chromatic tones, providing the sharps and flats to enable the assembly to play a fully chromatic scale of over two octaves. The port may be slide adjustable in distance from the proximal end of the horn permitting pitch tuning. Further, a selection of external threaded inserts of various internal bore diameters and heights may be provided for the port assembly permits fine tuning of the assembly.

The musical wind instrument may also comprise a user-operable valve on the horn assembly having a one half tone lower pitch than the basic pitch of the horn's, the valve that is normally a second valve of a valve-horn, where the user-operable valve is depressed except when wanting a sharp or flat added to the major scale of the horn being played.

BRIEF DESCRIPTION OF THE SEVERAL VIEWS OF THE DRAWINGS

FIG. 1 is an illustration of a horn having a waveguide reflector attachment according to aspects of the present disclosure herein;

FIG. 1A is an illustration of the bell portion of the horn of FIG. 1, showing an alternative configuration with of a waveguide reflector attachment having two waveguide reflectors, according to various aspects of the present disclosure;

FIG. 2 is an illustration of the horn of FIG. 1 stretched out, illustrating a waveguide reflector bracket according to aspects of the present disclosure herein;

FIG. 3 is an illustration of a horn having a waveguide reflector attachment according to further aspects of the present disclosure herein;

FIG. 4 is an illustration of a horn having an alternative waveguide reflector assembly according to further aspects of the present disclosure herein;

FIG. 5 is an illustration of an adjustable part of a horn, according to aspects of the present disclosure herein;

DETAILED DESCRIPTION

Figure 6:
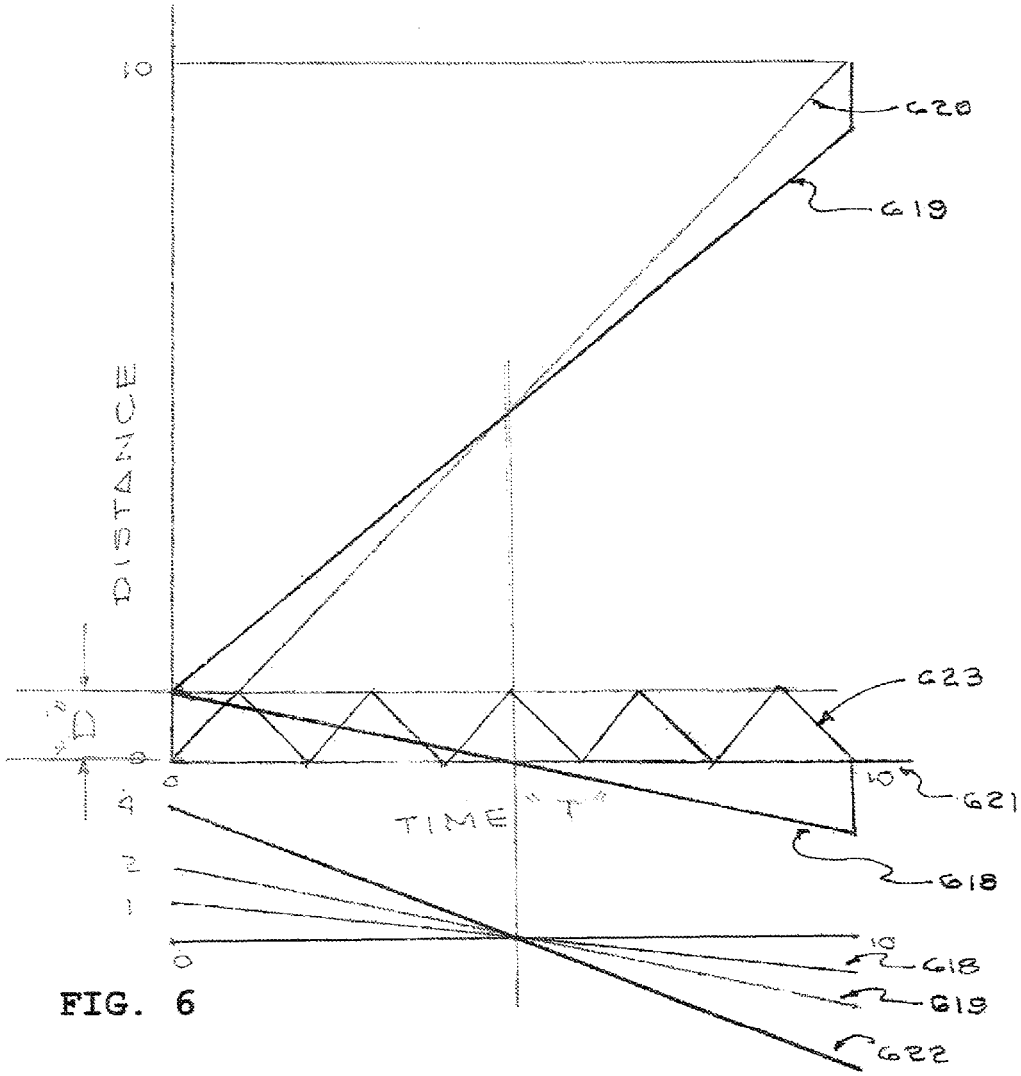
FIG. 6 is an illustration of the folding of one-half wave according to aspects of the present disclosure herein.

Various aspects of the present disclosure comprise a horn attachment that provides families of selectable pitches that are controlled by the accurate integral half wavelength filtering to match the musician's lip input frequency, and to make selections, matched to the lip input, so as to produce a full chromatic scale, e.g., of 2½ octaves.

As will be described in greater detail herein, an attachment is provided to fill in the otherwise missing notes of a musical scale by modifying an existing conventional horn that would not otherwise have the ability to play full scales with lip control only. In particular, the attachment increases the range of notes available to the performer from a non-valve horn. As such, attachments (or horns incorporating an attachment) as set out herein, eliminate the need for memorizing slide positions and/or valve combinations, physical coordination of lips to fingering, dexterity, and instant recall of pitch to valve, or slide position. To the contrary, a musician with a melody in mind can perform a composition with a 'bit of embouchure'.

The disclosures of U.S. Pat. No. 5,133,238, entitled "Musical Wind Instrument" by Ostendorf and U.S. Pat. No. 5,351,593, entitled "Musical Wind Instrument With Waveguide reflector Assembly" by Ostendorf are hereby incorporated by reference herein. These patents are hereinafter referred to as "the '238 and '593 patents."

Throughout the specification, like structure is illustrated with like reference numbers using the ones and tens digits. The hundreds digits increment with the FIGURE numbers. Thus for example, elements 102, 202, 302, etc. share common attributes, possibly in identical structure or as different embodiments of structure that is intended to implement a common function.

Introduction

As will be described in greater detail herein, a musical instrument is provided that may be used to play up to, and exceeding two octaves of a major scale, using breath and lip control alone, without requiring coordinated mouth and finger operations. For instance, an instrument according to aspects of the present disclosure has a single mouthpiece, an outer tubing assembly or horn connected to the mouthpiece on the proximal end, and a bell at the terminating distal end. The instrument also contains a waveguide reflector assembly located at the outer horn bell. The waveguide reflector assembly can be provided as an assembly that clips, attaches or otherwise secures to an existing instrument or the waveguide reflector assembly can be provided integral with a corresponding instrument.

In an illustrative implementation, the wave-guide reflector assembly includes at least one adjustably positioned waveguide reflector having an open (optionally flanged) proximal end, which is located at the outer horn bell end, a tubular body, and a closed adjustable distal end cap located in the area of the outer horn's bell. The number of wave-guide reflectors utilized can depend upon the desired degree of tonal quality and precision desired in the composite horn's scale. In yet another alternative implementation, the wave-guide reflector assembly has two waveguide reflectors positioned at such distances from the mouthpiece to the wave-guide butt end or to the cap end to provide for or eliminate certain scale pitches required for completion and/or perfection the composite horn's basic major scale.

The body of each waveguide reflector is built to a certain length and the waveguide reflector is located at a specific distance and position to establish an integral even half wave length from the mouthpiece to a reflecting surface (i.e., butt flange, or cap) of the waveguide reflector. An optional cylindrical slide length adjustment, on the wave-guide body is positioned to fine-tune the certain required notes and cancel by averaging other off key notes of the desired scale, e.g., major scale, of the horn. For instance, in an illustrative implementation, the cap of the waveguide reflector is positioned at an exact certain distance from the mouthpiece and the waveguide is configured to protect the wave from dissipation and distractions of a destructive nature, thus producing the desired tones.

Sound waves travel the air column created both to and from the mouthpiece to corresponding reflecting surfaces, responding to the lip frequency and half wave distances to the correct reflector, butt flange and/or cap end, either creating and amplifying the players lip frequency pitch or preventing another undesired pitch by averaging with an adjacent family's pitch of equal mode to provide an in-pitch pitch tone positioning. The outer horn has a length selected for the fundamental pitch whose family provides the most beneficial solution to the player's choice of range and family scale of pitches. The reflected air column lengths of the wave-guide reflector establishes new pitches to provide adding, subtracting, or cancelling by averaging pitches required to complete and/or perfect the selected outer horns major scale. See Table 1.

TABLE 1

| Pitch 1.05946x | Note | Horn A# Ff = 29.1352 | Mode | Reflector A Ff = 27.5000 | Mode | Port B Ff = 30.8676 | Mode | Reflector C Ff = 32.703 | Mode |
|---|---|---|---|---|---|---|---|---|---|
| 110.00 | A | | | 110.00 | 4 | | | | |
| 116.54 | A# | 116.54 | 4 | | | | | | |
| 123.48 | B | | | | | 123.47 | 4 | | |
| 130.82 | C | | | | | | | 130.81 | 5 |
| 138.59 | C# | | | 137.50 | 5 | | | | |
| 146.84 | D | 145.68 | 5 | | | | | | |
| 155.86 | D# | | | | | 154.34 | 5 | | |
| 164.81 | E | | | 165.00 | 6 | | | | |
| 174.61 | F | 174.81 | 6 | | | | | | |
| 185.00 | F# | | | 192.50 | 7 | 185.21 | 6 | | |
| 196.00 | G | 203.95 | 7 | 198.22 | 7 + 7 | | | | |
| 207.66 | G# | | | 210.01 | 7 + 7 | 216.07 | 7 | | |
| 220.00 | A | | | 220.00 | 8 | | | | |
| 233.08 | A# | 233.08 | 8 | | | | | | |
| 246.95 | B | | | 247.50 | 9 | 246.94 | 8 | | |
| 261.63 | C | 262.22 | 9 | | | | | | |
| 277.19 | C# | | | 275.00 | 10 | 277.81 | 9 | | |
| 293.67 | D | 291.35 | 10 | 302.50 | 11 | | | | |
| 311.13 | D# | | | 311.50 | 11 + 11 | 308.67 | 10 | | |
| 329.63 | E | 320.49 | 11 | 330.00 | 12 | 339.54 | 11 | | |
| 349.23 | F | 349.62 | 12 | 357.50 | 13 | | | | |
| 370.00 | F# | 378.76 | 13 | 368.13 | 13 + 13 | 370.41 | 12 | | |
| 392.00 | G | | | 396.45 | 14 + 14 | 401.27 | 13 | | |
| 415.30 | G# | 407.89 | 14 | | | | | | |
| 440.00 | A | 437.02 | 15 | | | | | | |
| 466.16 | A# | 466.16 | 16 | | | | | | |
| 499.90 | B | 495.30 | 17 | | | | | | |
| 523.16 | C | 524.43 | 18 | | | | | | |
| 554.27 | C# | 553.57 | 19 | | | | | | |
| 587.23 | D | 582.70 | 20 | | | | | | |

According to further aspects of the present disclosure, a modification is provided for an existing conventional horn, which eliminates the use/need for valves, except generally, the number 2 valve, if present. Another modification creates a tunable port offering a new fundamental pitch, which may also be one tone higher than the fundamental pitch of the conventional horn. (Ff×1.05946).

Waveguide reflector Assembly

Referring now to the drawings and in particular to FIG. 1, a musical wind instrument 100, e.g., a horn is provided. The instrument 100 comprises a single inlet in the form or a cup-shaped mouthpiece 102, a first, hollow outer tubing assembly (also referred to generally as a horn) 104 having a proximal end opening to an air column conduit of the mouthpiece 102, and a distal end terminating in a bell 106. The instrument includes an attachment according to aspects of the present disclosure herein, which comprises a waveguide reflector assembly 108. The waveguide reflector assembly 108 comprises a support bracket 110, e.g., spider-like legs or rods that clip on to the bell 106 (e.g., affixed as by clips to the edge surface of the bell 106), and two tubular waveguide reflectors, including a first waveguide reflector 112 and a second waveguide 114, that are attached to the horn 104.

Each waveguide reflector 112, 114 includes a guide body (i.e., tube). A waveguide reflector may also include a cap, slide adjustable length or other features as will be described in greater detail herein. The first waveguide reflector 112 is positioned at the bell 106 of the horn suspended by the support bracket 110, and the second waveguide reflector 114 which is a flange attached to 112.

In the illustrative example, the outer horn may be provided with conventional tuning slides and an 'accidentals' port for sharps and flats, both ports being near the bell to bow connection at the outer horn. For instance, also shown are the normal tuning slides 120 for horn pitch adjustment. Further, one approach to producing the sharps and flats necessary for certain compositions is with a port 122 (e.g., a screw plug port) to make the horn assembly fully capable of playing 2½ octaves of fully chromatic scales, as will be described in greater detail herein.

More particularly, the port 122 may be provided on the horn so as to be adjustably located and pitched to provide the next adjacent higher fundamental scale tone in sequence, beginning with the fundamental note of the horn, in the scale of chromatic tones, providing the sharps and flats to enable the assembly to play a fully chromatic scale of over two octaves. In this regard, the port 122 may be slide adjustable in a distance from the mouthpiece of the horn permitting pitch tuning. As another illustrative example, a selection of external threaded inserts of various internal bore diameters and heights may plug or screw into the port to provide control over the port size, and friction and thus the tuning accuracy.

According to aspects of the present disclosure, a distal end of the first waveguide reflector 112 is positioned at a distance, from a mouthpiece of the instrument to the distal end of the waveguide reflector, equal to a whole number sum of half wave lengths of the fundamental pitches selected. In a further illustrative example, an end of the first waveguide reflector 114 is positioned at a distance, from the mouthpiece to the proximal end of the first waveguide reflector, equal to an apparent whole number sum of half wave lengths of the fundamental pitches selected.

Referring to FIG. 1A, an alternate waveguide reflector positioning is provided, according to various aspects of the present disclosure. The waveguide reflector 112*a* is positioned at the bell 106 of the horn 100 held by support bracket 110*a*, and a second waveguide reflector 114*a* is positioned adjacent to the first waveguide reflector 112*a* and is also held by the support bracket 110*a*. Otherwise, the instrument 100 can have (but is not required to have) the same features as that set out above with reference to FIG. 1.

As described above, the waveguide reflector assembly comprises a waveguide tube and optionally, a cap, flange, bell, dome, taper, etc. The waveguide reflector is mounted inside a slide bearing or mounting tube affixed to the spider of the support bracket. The waveguide reflector assemblies are thus mounted at the distal end of the outer horn and have a proximal flanged end opening positioned at the outer horn bell and have an adjustable closed distal end projecting further outwardly of the bell.

Although various different combinations of horn lengths could be used, the following criteria is suitable for an instrument capable of playing two octaves of a complete major scale, according to still further aspects of the present disclosure. An outer horn has an effective air column length equal to the sound velocity in the ambient air conditions divided by the fundamental frequency of the horn. A mouthpiece providing an air inlet to the outer horn sized to enable one to play without substantial difficulty in a range of frequencies beginning at the 4/2 harmonic and extending through the 20/2 harmonic. In an illustrative implementation, the outer horn can be used to produce 9 of the 24 contiguous scale tones and without the waveguide reflector there would still will be missing 7 scale notes, the retention the 4 off-key notes, and 8 accidental port notes, providing the 8 sharp or flat notes for a full chromatic scale. Refer back to Table 1.

In general, the inner horn assembly enables the instrument 100 to be used to play two octaves of an acceptable scale (e.g., major scale) merely by the control of the "lip buzz" of the musician and without the manipulations needed to modify tubing lengths. The 'accidentals' port located in the outer horn tubing, when opened, produces an effective air column length equal to the sound velocity in the ambient air conditions divided by the fundamental frequency of the next higher scale one-half tone above the external horn fundamental frequency of the outer horn, would enable one to use the horn to play an acceptable two-octave range with excellent results.

A complete chromatic scale, that is, a major scale with all of the required sharps and flats (accidentals) can be produced if an accidentals port is added, e.g., in the side of tube at about the bell to bow connection to produce the accidentals air column length of the exterior horn to 16.81 feet from the mouthpiece, when opened, thereby enabling the production of a harmonic family of pitches based upon 30.8676 cycles per second (cps). The player senses an 'accidental' (non-major scale sharp or flat) in a musical composition and can utilize the port with reasonable accuracy. The accidentals port can be omitted if only a major scale is desired.

According to aspects herein, the waveguide reflector comprises a cap reflector that provides a first additional family of pitches and a flange at the base of the waveguide reflector that provides a second additional reflector to reflect a second family of pitches. Thus using an assembly of two waveguide reflectors can produce a four family response (horn, reflector 1, reflector 2 and port families).

The precise lengths of the air columns will depend upon ambient conditions, and the temperament or intonation desired by the player. The outer horn bore may be cylindrical or conical, or partly each, depending on the desired timbre. Also the average velocity in the horn air varies with the bore and friction in the air column in the horn, requiring tuning slide adjustment.

To achieve precisely the desired air column lengths under various different atmospheric conditions would require that tuning adjustments correcting the assumed velocity of sound used in calculations be provided for both the outer horn and the waveguide reflector.

Thus, in addition to the tuning slides, which enable tuning of the outer horn, the waveguide reflectors 212, and 214 may each also be provided with slide tuning capability analogous to the conventional slide tuning 120. According to further aspects of the present disclosure, the waveguide reflectors 112, 114 can alternatively include an adjustable cap for tuning.

Referring to FIG. 2, an instrument 200 is illustrated. The instrument 200 is analogous to the instrument 100 of FIG. 1. Thus, analogous features are referenced by numbers 100 higher than the counterpart in FIG. 1. In general, FIG. 2 illustrates the horn of FIG. 1 "unbent". FIG. 2 further illustrates a support bracket 210, two waveguide reflectors 212 and 214, an adjustable port 222, and conventional tuning slides 220. Also shown is a port 222 (e.g., a screw plug port), which allows the performer to play the sharps and flats necessary for certain compositions, e.g., as described more fully herein by reference to port 122 of FIG. 1.

Referring to FIG. 3, an assembly is illustrated according to further aspects of the present disclosure. Analogous features are referenced by numbers 200 higher than the counterpart in FIG. 1. The illustrated assembly comprises a support bracket 310 attached to the bell 306 of horn 304. The waveguide reflector bracket 310 has spider-like legs of rod for securement to the horn. Moreover, the assembly includes waveguide reflectors 312 and 314. The waveguide reflector 312 is clipped via a slide adjustable attachment 332 to the waveguide reflector bracket 310. A slide adjustable cap 336 is shown on the tubular waveguide reflector 312. Also shown is a flange 338 on the proximal end of waveguide reflector 312. The rods 334, which are utilized for the suspension of the second waveguide reflector 314 can connect to the attachment 332 about the flange 338. Waveguide reflector sliding adjustment tubes 340 are provided for the second waveguide reflector 314.

Referring to FIG. 4, yet another alternative waveguide reflector assembly is illustrated, according to aspects of the present disclosure. Analogous features are referenced by numbers 300 higher than the counterpart in FIG. 1. The illustrated alternative waveguide reflector assembly comprises a bell shaped waveguide 413 (without a cap), which is attached to a waveguide reflector spider clip-on attachment of a support bracket 410. In a manner analogous to that described above, the clip-on attachment of the support bracket 410 connects (temporarily or permanently) to the bell 406 of the instrument. A tubular capped waveguide reflector 412 is supported by rods 408 from the waveguide reflector 413. The waveguide reflector 402 is slide adjusted in a tube 411 such that a cap 436 is axially adjustable relative to the length of the corresponding waveguide. There is only a single cap 436 for the waveguide reflector 402. However, the cap 436 is shown in its minimum and maximum positions for sake of clarity of illustration of the slide adjustable feature. Additionally, suspension rods 408 are terminated as centering guides 412 for the waveguide reflector 402.

Referring to FIG. 5, an adjustable port for a horn comprises a partial horn body 505 with an elongated slot 516. Slide clips 514 are attached to the horn body 505, e.g., by soldering. Also, an air tight fitted slide 515 is provided. The illustrated fitted slide 515 has a circular internal threaded bore port with a variable tuning thickness and bores ports 517 for accepting interchangeable external bore and thickness ports 517.

An accidentals port may be located in a manually operated slide plate frictionally retained and guided by gibs. The accidentals port is typically closed by a key or the musician's finger, and is used to produce sharps and flats. The ported plate is slid over a portion of the tubing, which is provided with an elongated slot. As will be readily understood, the adjusted position of the port will determine the effective length of the air column created when the port is opened while the instrument is being played. The port, if used, could be made adjustable in the same manner. Notwithstanding the foregoing discussion concerning tuning adjustments, full tuning capability may not always be desired, especially because it is important to maintain the positions of the waveguide reflectors relative to the outer horn, which makes necessary to change the settings of the waveguide reflectors if port or the outer horn tuning slide have been repositioned.

According to illustrative aspects of the present disclosure, the position of this port is required to provide a fundamental pitch theoretically equal to ½ tone higher than the horn fundamental. If the horn was tuned to an Ff of 29.1352 cps the port would be tuned to 1.05946 times that amount or 30.8675 cps. The 'accidentals' port then, if used, is spaced to provide musical intervals of one half tone of higher pitch with respect to the originating outer horn pitch.

One waveguide reflector assembly may be concentrically located within the bell and the other possible waveguides could be arranged in an array about the axis of the waveguide reflector, and spaced from one another by equal separation. However, this arrangement of the inner horns is not critical; they need not be concentrically located within the bell nor need they be in a circular array.

The waveguide reflectors may be mounted in slide bearings or mounting tubes that are clustered in a rectangular array and mounted by a spider brazed to both the mounting tubes and to an outer horn bell. Optionally, the radial outermost parts of the spider could be bent to form hooks for clipping the waveguide reflector assembly as an attachment (not shown) to an existing horn.

Referring to FIG. 6, an exemplary graphic solution shows the folding of a one-half 'saw tooth' wave for simplicity) wave 619 which has a velocity of 10×'V' within the confinement of 'D' distance of the one-half 'saw tooth' sound wave 618 of the lower velocity of wave V. The higher velocity wave 619 must be an integer multiple 'n' times the velocity of the lower velocity wave 618's velocity. The frequency of the one-half sound wave 619 must be the same frequency of the one-half sound wave 618. The time 'T' elapsed for both one-half sound waves 619 and 618 must be equal, or said another way, the distance traveled by the one-half sound wave 619 is 'n' times the distance traveled by one-half sound wave 618. The abscissa 621 (time axis) of the graph is also the base line for the lower velocity saw tooth half wave. The wave has it maximum vertical ordinate indicating magnitude on the ordinate, axis and its minimum magnitude on the opposite, right end of the horizontal or time axis. Wave 622 at ordinate 4 represents the ordinate vector addition of the two waves 619 and 618 showing the sums amplification. Ordinate 4 shows the addition of the two one-half waves after one full wave over time '2T' interval. This applies only in those instances where the velocity of the sound in the body of a horn is an integer multiple of the velocity of sound in air.

Figure 7:
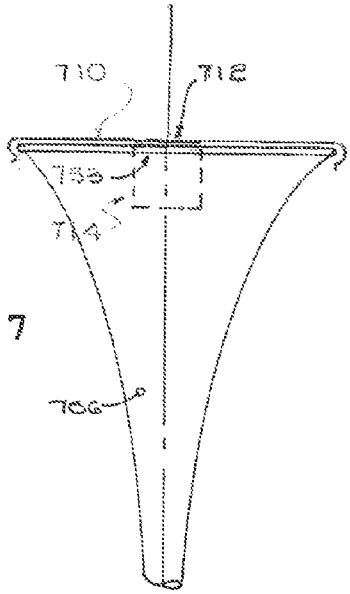
FIG. 7 is a side view of a waveguide reflector attachment according to further aspects of the present disclosure herein.

Referring to FIG. 7, a waveguide reflector attachment is illustrated according to still further aspects of the present invention. FIG. 7 only illustrates a partial view of a horn to which the attachment is connected for sake of clarity of disclosure. In practice, any horn set out and described with reference to FIGS. 1-6 may be used. As illustrated in FIG. 7, the attachment device includes a spider-like clip on bracket 710 that secures the attachment to a bell 706 of a corresponding horn (only partially shown). In the illustrative implementation, a waveguide reflector includes an adjustable shaft 712, e.g., which may be adjusted relative to the bracket 710. The waveguide reflector also comprises a waveguide tube 714 and a reflector 733 attached to the tube. The reflector 733 is positioned at the plane of the cross-section of the edge of the bell of the horn.

Figure 9:
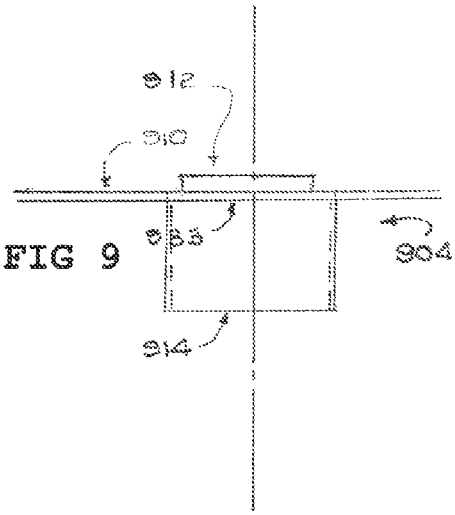
FIG. 9 is a side view of the waveguide reflector attachment of FIG. 7.

Referring to FIG. 9, a side view of a waveguide reflector is illustrated. For instance, the waveguide reflector of FIG. 9 may be functionally similar to or identical to that structure of FIG. 7. As illustrated, a bracket 910 (only a partial view of the spider like bracket is illustrated for clarity of discussion) clips to a bell of a horn (not shown) in a manner analogous to that described more fully herein. The illustrated waveguide reflector includes an adjustable shaft 912, e.g., which may be adjusted relative to the bracket 910. The waveguide reflector also comprises a waveguide tube 914 and a reflector 933. As noted above with FIG. 7, the reflector 933 is positioned at the plane of the cross-section of the edge of the bell of the horn.

Figure 8:
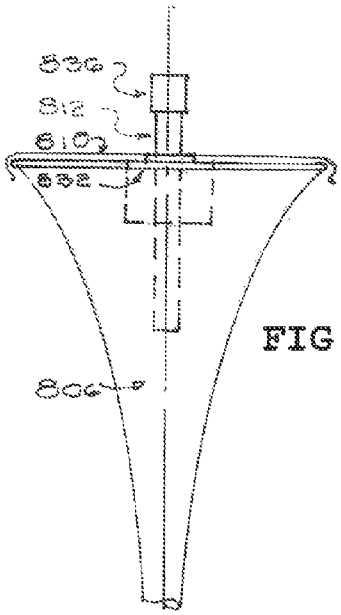
FIG. 8 is a side view of a waveguide reflector attachment according to still further aspects of the present disclosure herein.

Referring now to FIG. 8, a waveguide reflector attachment is illustrated according to still further aspects of the present invention. FIG. 8 only illustrates a partial view of a horn to which the attachment is connected for sake of clarity of disclosure. In practice, any horn set out and described with reference to FIGS. 1-7 may be used. As illustrated in FIG. 8, the attachment device includes a spider-like clip on bracket 810 that secures the attachment to a bell 806 of a corresponding horn (only partially shown). In the illustrative implementation, the bracket supports a waveguide reflector that is implemented as a waveguide tube 812 having a reflector 832 positioned along the tube so as to be located about a plane defined as a cross-section across the end of the bell 806 of the horn (in the illustrated example). The waveguide reflector is adjustable in the bracket 810 so as to extend past the end of the bell of the horn. For instance, the waveguide reflector includes an adjustable reflector cap 836. Otherwise, the formulas, techniques and structures set out more fully herein with regard to FIGS. 1-7 may be applied to the structure of FIG. 8.

Figure 10:
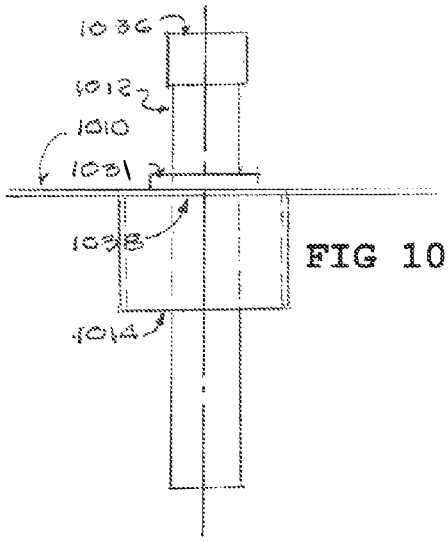
FIG. 10 is a side view of the waveguide reflector attachment of FIG. 8.

Referring to FIG. 10, a side view of a waveguide reflector is illustrated. For instance, the waveguide reflector of FIG. 10 may be functionally similar to or identical to that structure of FIG. 8. Referring to FIG. 10, the attachment device includes a spider-like clip on bracket 1010 that secures the attachment to a bell of a corresponding horn (only partially shown). In the illustrative implementation, a waveguide reflector 1014 is implemented as a waveguide tube 1012 having a reflector 1038 positioned along the tube so as to be located about a plane defined as a cross-section across the end of the bell of the horn. As illustrated, the waveguide reflector 1014 is coupled to a slide adjustment tube 1031 that attaches to the bracket 1010. The waveguide reflector is adjustable in the bracket 1010 so as to extend past the end of the bell of the horn. For instance, the waveguide reflector includes an adjustable reflector cap 1036. Otherwise, the formulas, techniques and structures set out more fully herein with regard to FIGS. 1-9 are used as a basis and may be applied to the structure of FIG. 10.

Example Horn

Various aspects of the present disclosure are best understood with an example that looks at the mathematics and physics of musical sounds. A Bb basic horn, with a fundamental frequency of 29.1352 cps, is used, but not limited to herein, and serves only as an example.

This instrument can be played for instance, in the Bb trombone range, and will be played the key of "F". Moreover, the instrument will have as its lowest scale note "Mi", the A which has a frequency of 110.00 cycles per second and be the 4/2 harmonic of the external horn. Other pitches might have been selected. As one can imagine the selected matching of the 8/2m harmonic to be A# is only one of 12 possible scale tone matches. The interval between the families of pitches is also the fundamental pitch which is 29.135 cps. The air column length of the horn air column is about 18.92 feet at certain conditions of temperature, pressure, humidity and horn characteristics.

Aspects of this disclosure have, as an objective, to add range to the lower end of the usable scale, both major and chromatic; from two octaves to two and one-half octaves.

Every note of the scale has a pitch. For example A4 440 meaning a note 'A4' with 440 vibrations or cycles per second (cps). Another example would be A3 having 330 cps. Another might be A2 having 220 cps. More simply stated we might identify the notes as A4, A3 and A2 and we know by accepted conventions they will have frequencies of 440, 330, and 220 cps.

Every note has another property, wavelength, which is related to its' frequency and the velocity of sound in the material in which that sound is traveling. For example, air at a certain conditions of temperature, density and moisture content, will have sound waves velocity of 1142 feet per second. 'A' with its frequency of 440 cps in the above mentioned air, traveling at 1142 ft/s will move a distance of 2.591 ft. for each wavelength, 440 times each second.

Expressed as a formula; wavelength equals velocity divided by frequency. L=V/f, 2.591=1140/440. The wavelength of note 440 cps 'A' is 2.595 ft.

Thus, every horn required to play the note 'A' must be some integer number (n) times the half wavelength of 'A'." One half of the wavelength of 'A' equals 1.296 ft. The horns that can play an 'A' are set out below in Table 2.

TABLE 2

| Length (ft) | n | Plays (cps) | Scale | Note (cps) |
|---|---|---|---|---|
| 1.296 | 1 | 879.62 | A5 | 880.00 |
| 2.592 | 2 | 439.81 | A4 | 440.00 |
| 5.1824 | 4 | 219.91 | A3 | 220.00 |
| 10.3680 | 8 | 109.95 | A2 | 110.00 |

Another way a stating the above formula is, "all of the members, of its' family of pitches, established by a fundamental pitch, are the frequency separation from its' adjacent family members, by the amount of the frequency of the fundamental pitch itself". Or, for each increase of 1 in the value of 'n' in a family of pitches, the frequency separation is by the amount of the fundamental pitch itself e.g., as set out in Table 3.

TABLE 3

| Pitch | Plays | Scale | Note | Ff Separation |
|---|---|---|---|---|
| Fundamental Pitch (Ff) | 220.00 | A3 | 220.00 | 220.00 |
| Second Pitch in Family | 440.00 | A4 | 440.00 | 220.00 |
| Third Pitch in Family | 660.0 | E3 | 660.00 | 220.00 |
| Fourth Pitch in Family | 880.00 | A5 | 880.00 | 220.00 |

Another consideration concerns the pitches used in the scales. There is a rather complicated basis for harmonics and it provides for us the scale of Just Intonation. Western musicians use a mathematical substitution for the exact scale, referred to as the scale of Equal Temperament. The Scale of Equal temperament multiplies any given note by the twelfth root of two (1.05946 the scale constant) to arrive at the next higher note. For example, 440.0(A)×1.05946=466.16 which is A# etc.

Thus, an illustrative approach is to try to match the scale of equal temperament with the harmonic families of notes. One series is exponential and the other is arithmetic. Table One will show the matching and offer a bit of assistance in understanding the things involved here.

As it happens when the scale of Equal Temperament (an exponential series based upon the multiplier, 12th root of 2, or 1.05946), as accepted by western musicians, is matched to the arithmetic series of 'n' times the fundamental there are mismatches appearing. The worst of which is at the 7/2 modes as mentioned above. The 7.2's are almost one half tone in error. But this is very convenient for the averaging and application herein. (29.1353+27.500)×½=28.3176 nearly equal to the fundamental pitch of 'G' which is 28.4000.

Should one desire to have a full chromatic scale a port (Ff 30.8676 cps) can be added, or in the case of a musical instrument with valves, we can play with the 2nd valve (one half tone) depressed normally and then allowed to rise when a sharp or flat note is required.

In many practical applications, it is reasonable to keep the sharp and flat notes under a separate method of control, other than lip control, as they are normally "felt" by the musician in a performance, and can be entered by a separate operation of raising a valve or opening a port. If lip control alone is desired, another waveguide reflector may be added to provide for that need.

In wave motion, the cycles of the frequency alternate from node to anti-node. The 'terminal conditions at the proximal end of a horn must be identical to conditions at the distal end'. If a node is at the mouthpiece, there must also be a node at the bell end. The same is true of the anti-node. This happens when the length of a horn is equal to an exact whole number times the half-wavelengths of the note being played. At the instant that a node is at both ends of the wave, that is, one at the bell and one at the mouthpiece there will be no sound as the reflections cancel the previous traces. At the instant that the anti-node is at both ends of the wave there will be vector addition along the wave of the ordinate magnitude causing a standing wave and amplification. These waves form the standing wave. It amplifies the horn's volume. It takes a simple lip buzz, and converts it to a ringing sound.

To the sound wave in the horn's body, many will say the velocity of sound in brass, 11,417.88 feet per second (f/s) is far too fast to relate to the slower velocity of sound in air at about 1140.29 f/s. Notably, the brass value divided by to air value exactly 10.013. This suggests, since the musician has control of the motion portion, air from the musician's breath passing through the horn, of the horn's 'air velocity' of sound, could be slightly adjusted to equal one tenth of the 'brass velocity' and a reflection can exist. FIG. 6 is a graphic solution which shows most clearly the reflective premise. This reflective movement through the horn body gives rise to the body being excited by the pulsating air column is a true resonator of the sought sound. Exploring the values the body could respond to values as set out in Table 4.

TABLE 4

| Folding Ratio | Folded Velocity | Brass Length | Brass Ff |
|---|---|---|---|
| 11 | 1037.99 | 18.8725 | 27.50 |
| 10 | 1141.79 | 18.8725 | 30.25 |

Comparing a complementary air column fundamental pitch, computed (Ff Brass+Ff Air)½=Required Pitch) to provide the required scale pitch average, yields the following, set out in Table 5.

TABLE 5

| Device | Fundamental Required (cps) | Fundamental Brass | Fundamental Air (cps) | Length (feet) | waveguide reflector or Pt to Bell (feet) |
|---|---|---|---|---|---|
| Refl. C | 32.71 | d.n.c. | 32.71 | 19.84 | 0.00 |
| Port B | 30.87c | d.n.c. | 30.87 | 16.81 | 2.06 |
| Horn A# | 29.14 | d.n.c. | 28.30 | 18.93 | 0.00 |
| Refl. A | 27.50 | 27.50 | 27.50 | 18.87 | 0.00 |
| Refl. G# | 25.95 | d.n.c. | 25.95 | 19.99 | 2.80 |

d.n.c.=does not compute

An illustrative but non-limiting example of determining the positions of the port, reflector proximal end, reflector distal end, or combinations thereof is as follows. The velocity of sound in air for a representative horn was experimentally established as 1037.99 ft/s in computations, and the horn itself was found to have an apparent velocity of sound in air of 1100.00 ft/s. The horn has a metal body centerline length of 18.93 ft. and a metal curved length of 19.05 ft. The complication of the bell physics excludes it from use with our simple calculated length formula, of V=F×L. However, simple testing suggests the fundamental velocity of the horn being equal to 29.1352 cps. For example, when the proper velocity of sound in air is divided by the fundamental pitch of the air column it provides the length from the mouthpiece to the port, end, or waveguide reflector cap.

Special consideration for the projection of the waveguide reflector was required for the G# unit. It did not fit the horn in a convenient manner. The full family of pitches was not required, only the C at 130.81 cps.

The half wavelength for 'C' at 130.81 was computed at 3.9675 ft. This half wavelength of 'C' was multiplied by 5 to establish the fundamental reflector position length at 19.8377 ft. for a reflector cap position.

The position of a port for the fundamental pitch 'B' at 16.81° from the mouthpiece provides all of the sharps and flats required for the chromatic scale, is at about the juncture of the bell and the bow of the Bb horn.

According to further aspects of the present disclosure, a screw plug port is provided, which can be utilized to gain fine tuning control over additional notes that could not otherwise be achieved with a stationary port itself.

Moreover, according to further aspects of the present disclosure, an enlarged flange proximal to the end of the waveguide reflector can be utilized as the reflector.

Aspects of the present disclosure provide a musical wind instrument which may be used to play more notes than possible with a conventional instrument having a fixed overall tube length but which is less complex to play when compared to a conventional wind instruments, having the required mechanisms for changing their tubing lengths. In a particular, a musical wind instrument is provided, that may be used to play a complete major scale with embouchure control only. Moreover, a musical wind instrument is provided, which may be used to produce a complete chromatic scale (containing all 'accidentals', e.g. sharps or flats) by a single port, with a minimal mouth and finger coordination.

In an example, the waveguide reflector would have as its family of pitches a mean average fundamental pitch comprised of the 'A' family of notes' fundamental pitches at the cap end, and the fundamental pitch of the 'B' port's family of notes sought for the fundamental pitch at the port, for the major scale selected. As stated, as the number of the inner horns increases, and their 'insertions' are made at the bell end of the outer horn, the effort of the horn playing increases. However, as also previously stated, as the number of waveguide reflectors increases, from the viewpoint of frequency accuracy, the quality improves. Therefore, some judgmental decisions must be made to achieve an optimal solution.

The waveguide reflector assembly provides at least two beneficial results. Additional scale tones can be produced without the use of valves or slides and the pitch of certain off key tones produced by the outer horn can be cancelled by averaging. These results do not necessarily occur simultaneously as every note is called into play by the musician, with his or her lip configuration at the inset of blowing, by the musician, and at the desired frequency.

Each waveguide reflector may optionally have a telescoping slide for adjusting its air column length to be correct for the length of the desired pitch offering or a position for canceling an unwanted off-key note. Each waveguide reflector may also be adjustable to different length by cap slide positions relative to the distal end of the waveguide reflector to adjust or correct the pitches for the instrument.

In another aspect of this disclosure, an attachment may be provided that adds a waveguide reflector assembly having multiple waveguide reflectors, as described above, to an existing conventional valve operated or slide operated horn, to convert the existing valve or slide horn to an instrument capable of playing a major scale without the use of its' valves or slides.

According to further aspects of the present invention, a musical instrument is provided that offers an increased range of notes that can be generated without relying upon valves, slides or other hand-operated gesture controls. That is, all available notes are obtained by using the mouthpiece alone. For instance, a wind musical instrument can be realized using three horns, which achieves a 'lip control only' horn that is capable of two octaves. The three horns include the basic horn (horn 1), with a fundamental pitch; a port ('horn 2') with a fundamental pitch ½ tone above the basic horn fundamental; and a waveguide reflector ('horn 3') with a fundamental pitch ½ tone below the fundamental pitch of the basic horn.

If another waveguide reflector is added, which is tuned to one tone below the basic horn fundamental, the performance range of available notes can be extended to more than two octaves, e.g., two octaves and five notes.

According to various aspects of the present invention, the waveguide reflectors are positioned on the instrument so as to be positioned out of the bell by having the proximal end of the waveguide reflector at the bell end. A fourth 'horn' may be implemented using the proximal end of a third waveguide reflector, e.g., using a flanged opening. However, the length is subject to some minimum length. At some point, the range of available notes becomes a tradeoff with the sonority of the instrument. For instance, the less that is placed inside the bell of the instrument, the subjectively-better the sound quality.

According to alternative aspects of the disclosure herein, the waveguide reflector assembly includes one outer horn and one or more tubular waveguide reflectors having open, upstream or proximal ends generally located at about the outer horn bell and closed downstream or distal ends located, downstream from the belled end of the outer horn. The waveguide reflector can have an open downstream or distal end that can be either belled or tubular. Also, the use of two or more waveguide reflectors, or one waveguide and one port, for producing additional scale notes is contemplated. The use of the reflecting capacity of the waveguide reflector increases the reflectivity capability by adding to the impedance at the bell of the outer horn. A benefit of this increased reflectivity is to improve the efficiency of the horn, permitting a greater volume range, decreased blowing effort and possible superior musician artistry.

According to still further aspects of the present invention, horn attachments provide improved placement of pitches via the averaging within a single air column. In this regard, the disclosure herein sets out the mathematics for supporting folding of metal column velocities of sound wavelengths within a horn length to match air column velocities.

According to certain aspects of the present disclosure herein, a desired pitch may be produced optimally when the distance from the mouthpiece to the reflective proximal butt or reflective distal end cap of a waveguide reflector is a product of an integral number of half wavelengths of the same sought pitch. The tubular portion of the waveguide reflector may thus have a relationship to the desired reflected pitch and it also serves as a wave-guide.

According to still further aspects, the a 'tapping pitch', that is, the pitch heard when the waveguide reflector when tapped by a small hammer, produces a pitch closer to the sought usable pitch than searching for the pitch by blowing over the open end of the waveguide tube the waveguide reflector, and thee tapped scale note that would be one utilized if required.

The waveguide and reflector assembly comprises a sound waveguide and reflector of such length and position as may be calculated, each comprising one or more adjustable straight tubes open at the flanged proximal or upstream end and closed with an adjustable end cap at its downstream or distal end. The horn assembly could comprise one, or more wave-guide reflectors, plus an adjustable port depending upon the pitch accuracy desired, range and completeness desired. The square relationship between the blown waveguide pitch and the tapped waveguide pitch is expresses by the following formula: The blown pitch equals the tapped pitch less the 0.00007 times the tapped pitch squared.

Exemplary Calculations

Exemplary calculations for a two reflector and single port horn assembly are as follows: Table 1 (above) offers the result of the calculations.

In this illustrative but non-limiting example, while the velocity of sound in the horn body may be 11417.88 f/s and the velocity of sound in the air column is 1141.79 f/s, that high velocity of sound can be reflectively folded in the length of the horn body as 11417.88/1141.79=10 times, making it responsive to resonate at the frequency of the air column frequency induced. See FIG. 6 of the drawings.

No calculation was required for the 'A#', 29.1352 frequency of the horn, as it would be built into the horn by the manufacturer, who would build a horn in the fundamental range and then adjust the tuning slides to the exact 29.1352 pitch sought.

Assuming the fundamental pitch of the horn to be 29.1352 cps, the horn family would provide the notes that are, n×Ff, or for the fifth mode 'n', 5×29.1352=145.68 cps or 'D' which is 'La', in our key of 'F' scale example here.

With or horn fundamental pitch as 29.1352 or 'Bb' the 'A' fundamental frequency would be, Ff (horn) divided by the scale constant or 29.1352/1.05946=27.5000 cps and the position would be one-half of the velocity of sound in the horn air divided by the fundamental pitch of 'A' or ½×1037.99 f/s/27.5000=18.87 feet from the mouthpiece.

The formula for the family of frequencies provided by the 'A' reflector is, any integer times the fundamental frequency. For the fifth mode, 5×27.5000=137.5 cps 'C# or La in this exemplary scale.

For the 'B' port the calculations are as follows; the fundamental pitch is equal to the fundamental pitch of the horn times the scale constant or 29.1352×1.05946=30.8676 cps.

With the fundamental for 'B' equal to 30.8676 the family of notes provided would be n×Ff or for example the fifth mode of the 'B' port, 5×30.8676=154.34 cps.

For the position of the 'B' port, the velocity of air in the horn column is again 1037.99 f/s times ½ divided by the fundamental pitch of the port 30.8676 equals 16.81 feet from the mouthpiece.

For the missing note 'C' that adds a lower range to the assembly, the normal methods of calculation provide results that were cumbersome to a player resulting in a special method of calculation. The family containing C=130.82 is exponential but work must be implemented with families that are arithmetical. Moreover, the matches are slightly inexact. The fundamental pitch for the 'C' family would be the horns family pitch 29.1352 times the scale constant 1.05946 squared, which equals 32.7030 cps. Next the wavelength of the desired 'C' 130.81 is found as one half of the velocity of sound in horn air 1037.99 f/s divided by 130.81 cps equals 3.9675, the one-half wavelength. We then add the half wavelength of 'C' to itself until we reach a total half-wavelength that can be worked with comfortably. For instance, 4 times the one half wave length is 15.87 ft. and 5 times the half wave length is 19.84 ft., neither is good.

Formula for the Cancellation of Pitches

The off pitch 7 mode pitches that are of equal mode may be averaged to produce the sought pitch. E.g. wanted G 196.00 cps. The $7^{th}$ mode of the horn, 203.95, may be added to the $7^{th}$ mode of the 'A' waveguide, 192.50, producing a new average frequency of 198.22 and subordinating the $7^{th}$ modes of the horn and the waveguide.

The off pitch $11^{th}$, $13^{th}$ and $14^{th}$ modes are corrected in a similar manner.

The waveguides when properly inserted into the bell, will generally be at about the bell for better sound production and ease of playing. The length will be a calculated value that produces the selected pitch, as determined by the formulations above. In general, the proximal end of each waveguide reflector will be upstream short of the distal end of the bell of the outer horn While the disclosure has been particularly shown and described with reference to the preferred embodiments thereof, it will be understood by those skilled in the art that various alterations in form and detail may be made therein without departing from the spirit and scope of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure.

Having thus described the disclosure of the present application in detail and by reference to embodiments thereof, it will be apparent that modifications and variations are possible without departing from the scope of the disclosure defined in the appended claims.

What is claimed is:

1. An attachment to a musical wind instrument (horn), comprising:

a waveguide reflector assembly including:

a support bracket that clips to a bell of the musical wind instrument (horn); and a waveguide reflector comprising a waveguide and a reflector;

wherein the waveguide and reflector are positioned adjustably by the support bracket so that a produced pitch is controlled by integral half wavelength filtering of input frequencies that match only the fundamental pitch selected to be one chromatic scale note lower than the fundamental pitch of the horn, bringing the entire family of related harmonic pitches and adding a capability to provide a complete major scale of over two octaves, controlled only by the lips of the player.

2. The attachment of claim 1, wherein:

a distal end of the waveguide reflector is positioned at a distance from the mouthpiece of the musical wind instrument equal to a whole number sum of half wave lengths of the pitch selected, to be one chromatic scale note lower than the fundamental pitch of the musical wind instrument (horn).

3. The attachment of claim 1 further comprising:

a second waveguide reflector, wherein the second waveguide reflector is positioned adjustably by the support bracket so that a produced pitch is controlled by integral half wavelength filtering of input frequencies that match only the fundamental pitch selected to be at a pitch that is the second note lower in the chromatic scale beginning with the fundamental pitch of the horn, bringing the entire family of related harmonic pitches and adding a capability to provide a complete major scale of over two octaves, controlled only by the lips of the player.

4. The attachment of claim 3, wherein:

the proximal end of the second waveguide reflector is positioned at a distance from the mouthpiece of the musical wind instrument equal to a whole number sum of half wave lengths of the pitch selected.

5. The attachment of claim 3 further comprising:

a third waveguide reflector, wherein the third waveguide reflector is positioned adjustably by the support bracket so that a produced pitch is controlled by integral half wavelength filtering of input frequencies that match only the fundamental pitch selected to be at a pitch that is the third note higher in the chromatic scale beginning with the fundamental pitch of the horn, bringing the entire family of related harmonic pitches and adding a capability to provide a complete major scale of over two octaves, controlled only by the lips of the player.

6. The attachment of claim 1, wherein:

the waveguide reflector has a slide length adjustment on a body of the waveguide for fine-tuning its fundamental pitch.

7. The attachment of claim 1, wherein:

the waveguide reflector comprises a cap reflector that provides a first family of pitches and a flange at the base of the wave guide reflector that provides a second reflector to reflect a second family of pitches.

8. The attachment of claim 1, wherein:

the waveguide reflector is a select one of: open, belled, domed and flat on a select end.

9. The attachment of claim 8, wherein:

a body of the waveguide reflector is a select one of: cylindrical, conical, and with a return bend.

10. A musical wind instrument, comprising:

a bell;

a mouthpiece;

a horn assembly comprising a tube that connects the bell to the mouthpiece through a hollow in the tube;

a waveguide reflector assembly including:

a support bracket that clips to the bell; and a waveguide reflector comprising a waveguide and a reflector;

wherein the waveguide and reflector are positioned adjustably by the support bracket so that a produced pitch is controlled by integral half wavelength filtering of input frequencies that match only the fundamental pitch selected to be one chromatic scale note lower than the fundamental pitch of the horn, bringing the entire family of related harmonic pitches and adding a capability to provide a complete major scale of over two octaves, controlled only by the lips of the player.

11. The musical wind instrument of claim 10, wherein:

a distal end of the waveguide reflector is positioned at a distance from the mouthpiece of the musical wind instrument equal to a whole number sum of half wave lengths of the pitch selected.

12. The musical wind instrument of claim 10 further comprising:

a second waveguide reflector, wherein the second waveguide reflector is positioned adjustably by the support bracket so that a produced pitch is controlled by integral half wavelength filtering of input frequencies that match only the fundamental pitch selected to be at a pitch that is the second note lower in the chromatic scale beginning with the fundamental pitch of the horn, bringing the entire family of related harmonic pitches and adding a capability to provide a complete major scale of over two octaves, controlled only by the lips of the player.

13. The musical wind instrument of claim 10, wherein:

the proximal end of the second waveguide reflector is positioned at a distance from the mouthpiece of the musical wind instrument equal to a whole number sum of half wave lengths of the pitch selected.

14. The musical wind instrument of claim 10 further comprising:

a third waveguide reflector, wherein the third waveguide reflector is positioned adjustably by the support bracket so that a produced pitch is controlled by integral half wavelength filtering of input frequencies that match only the fundamental pitch selected to be at a pitch that is the third note higher in the chromatic scale beginning with the fundamental pitch of the horn, bringing the entire family of related harmonic pitches and adding a capability to provide a complete major scale of over two octaves, controlled only by the lips of the player.

15. The musical wind instrument of claim 10, wherein:

the waveguide reflector has a slide length adjustment on a body of the waveguide for fine-tuning its fundamental pitch.

16. The musical wind instrument of claim 10, wherein:

the waveguide reflector comprises a cap reflector that provides a first family of pitches and a flange at the base of the wave guide reflector that provides a second reflector to reflect a second family of pitches.

17. The musical wind instrument of claim 10 further comprising:

a port provided on the horn assembly adjustably located and pitched to provide the next adjacent higher fundamental scale tone in sequence, beginning with the fundamental note of the horn, in the scale of chromatic tones, providing the sharps and flats to enable the assembly to play a fully chromatic scale of over octaves.

18. The musical wind instrument of claim 17, wherein:

the port is slide adjustable in a distance from the proximal end of the horn permitting pitch tuning.

19. The musical wind instrument of claim 17 further comprising:

a selection of external threaded inserts of various internal bore diameters and heights for the port assembly that permits fine tuning of the assembly.

20. The musical wind instrument of claim 10 further comprising:

a user-operable valve on the horn assembly having a one half tone lower pitch than the basic valve that is normally a second valve of a valve-horn, where the user-operable valve is depressed except when wanting a sharp or flat added to the major scale of the horn being played.

* * * * *